United States Patent [19]

Scherbatskoy

[11] 4,181,184

[45] Jan. 1, 1980

[54] SOFT-WIRE CONDUCTOR WELLBORE TELEMETRY SYSTEM AND METHOD

[75] Inventor: Serge A. Scherbatskoy, Ft. Worth, Tex.

[73] Assignee: Exxon Production Research Company, Houston, Tex.

[21] Appl. No.: 849,835

[22] Filed: Nov. 9, 1977

[51] Int. Cl.[2] ..... E21B 47/12

[52] U.S. Cl. ..... 175/65; 175/105; 174/47

[58] Field of Search ..... 175/45, 104, 57, 65; 166/65 R; 174/47, 110 AR, 110 N

[56] References Cited

U.S. PATENT DOCUMENTS 3,825,629 11/1966 Cullen et al. ..... 175/104

*Primary Examiner*—William Pate, III

*Attorney, Agent, or Firm*—M. A. Nametz; R. B. Martin

[57] ABSTRACT

A resilient conductor having an outer flexible insulating coating and an inner flexible conducting core is employed in a drill string to maintain an electric circuit between a subsurface and surface location. The conductor is inserted in the drill string in a generally free-hanging, random fashion to store excess length of conductor which is utilized as the drill string is lengthened. The stored conductor can be maintained in the drill string in a generally untangled state due to its kink-resistant mechanical and physical properties. Moreover, the frictional drag of the flowing drilling fluid tends to straighten and disentangle the conductor.

14 Claims, 4 Drawing Figures

SOFT-WIRE CONDUCTOR WELLBORE TELEMETRY SYSTEM AND METHOD

BACKGROUND OF THE INVENTION

1. Field of the Invention

This invention generally relates to an improved apparatus and method useful in wellbore telemetry operations. In particular it relates to an improved apparatus and method for establishing and maintaining electric continuity between a subsurface location in a rotary drill string and a surface location as drilling progresses.

2. Description of the Prior Art

In the drilling of oil wells, gas wells, and similar boreholes, it frequently is desirable to transmit electric energy between subsurface and surface locations. One application where electrical transmission has received considerable attention in recent years is in wellbore telemetry systems designed to sense, transmit, and receive information indicative of a subsurface condition. This operation has become known in the art as "logging while drilling".

A major problem associated with wellbore telemetry systems has been that of providing reliable means for transmitting an electric signal between the subsurface and surface locations. This problem can best be appreciated by considering the manner in which rotary drilling operations are normally performed. In conventional rotary drilling, a borehole is advanced by rotating a drill string provided with a drill bit at its lower end. Lengths of drill pipe, usually about 30 feet long, are added to the drill string, one-at-a-time, as the borehole is advanced in increments. In adapting an electric telemetry system to rotary drilling equipment, the means for transmitting the electric signal through the drill string must be such to permit the connection of additional pipe lengths to the drill string as the borehole is advanced.

An early approach to the problem involved the use of continuous electric cable which was adapted to be lowered inside the drill string and to make contact with a subsurface terminal. This technique, however, required withdrawing the cable from the drill string each time a pipe length was added to the drill string. A more recent approach involves the use of special drill pipe. Each pipe section of the special pipe is provided with an electric conductor having connectors at its opposite ends. Electric continuity is maintained across the junction of two pipe sections by connectors of one section contacting a connector on the adjacent pipe section (U.S. Pat. Nos. 3,518,608 and 3,518,609). Disadvantages of this system include the high cost of the special pipe sections, the need for a large number of electric connections (one at each joint) and the difficulty of maintaining insulation of the electric connectors at each joint.

Still another approach involves the use of cable sections mounted in each pipe section (U.S. Pat. No. 2,748,358). The cable sections are connected together as pipe sections are added to the drill string. Each cable section is normally made slightly longer than its associated pipe section, with the result that a small amount of slack is present in the conductor string at all times. Drilling fluid flowing through the drill string exerts a fluid drag on the loose cable which tends to damage the connectors or snarl the cable.

More recent developments in cable systems for wellbore telemetry operations are described in U.S. Pat. No. 3,825,078, "Method of Mounting and Maintaining an Electric Conductor and Drill String," and U.S. Pat. No. 3,957,118, "Cable System for use in a Pipe String and Method for Installing and Using the Same". The cable systems disclosed in both patents employ a looped, stranded armored cable stored within the drill string by means of guides and pulleys which permits the cable string to be extended as the drill string is lengthened. Experience with the first system has indicated that long sections of the overlapped cable sometimes become permanently entangled as a result of pipe rotation and fluid flow in the pipe string. The second system adds a cable gripping device and special locking connector to maintain a portion of the cable in tension, thereby mitigating cable entanglement. Although the cable tensioning improved performance, cable entanglement was not completely eliminated, particularly for very long overlapped sections.

SUMMARY OF THE INVENTION

The method and apparatus of the present invention is adapted for use in well drilling operations wherein an electric conductor disposed in a pipe string is employed to transmit electric energy between a subsurface and surface location. The conductor is disposed within the pipe string to provide stored conductor which may be withdrawn as the pipe string is lengthened.

In this system, the cumbersome pulleys and guides used in prior systems are replaced by a flexible conductor having special resilient properties and density. This flexible conductor is referred to herein as a "soft-wire" conductor. In the system of the present invention, the extendable cable portion comprises a very flexible insulated soft-wire conductor loop disposed in the drill pipe. The soft-wire conductor is designed to have approximately the same specific gravity as the drilling mud. The soft-wire conductor is straightened by frictional drag from the drilling mud and does not become permanently tangled in spite of the numerous sudden stops and starts of pipe rotation since, because of its nearly equal specific gravity, the soft-wire conductor rotates only along with the mud and not from the inertia of a cable having greater specific gravity.

In practicing the invention, the flexible, soft-wire conductor is disposed within the drill string in a free-hanging, random configuration to store excess extendable conductor. No specific overlapped configuration of the soft-wire conductor is necessary, so long as excess conductor lengths are introduced into the drill string in some fashion. A support member is provided within the drill string which maintains an armored conductor portion extending from the subsurface location to the support member in tension, and enables connection between the soft-wire conductor and the armored cable portion.

The soft-wire conductor preferably includes an inner multistrand conducting core and an outer, flexible, resilient insulating sheath of substantial thickness. The soft-wire conductor is designed such that when tangled or snarled by external forces (e.g. rotary drilling forces or drilling fluid flow forces), the forces necessary to cause resumption of original shape are stored by the flexible sheath of the conductor. Thus, when the external force is removed or reduced, the soft-wire conductor has a tendency to resume its original shape, permitting the soft-wire conductor to be withdrawn from the drill string without forming kinks or knots as the drill string is lengthened as drilling progresses.

To reach a satisfactory balance of tensile strength, specific gravity and surface area subject to fluid flow drag, a sheath of suitable insulating material such as EPDM rubber can be used. Other suitable materials for this purpose may include natural rubber, any of several synthetic rubbers and water-proofed, braided fiber compositions fabricated from polyester material or an aramid such as DuPont's "Kevlar" for example. Combinations of these materials may also be used.

Preferably, the composite specific gravity of the soft-wire conductor is adjusted to approximate the specific gravity of the drilling fluid. Thus, the snarling effect of rotary forces from acceleration or deceleration of the drill string is greatly reduced, since the soft-wire conductor tends to accelerate or decelerate at the same rate as the drilling fluid itself.

Important advantages of the invention over prior art techniques are that long lengths of free-hanging conductor may be stored within the drill string, i.e. the use of special guides or the like to maintain stored conductor in overlapped configuration is unnecessary; the problem of snarling of the stored conductor portions is essentially self-corrective, since the conductor tends to resume its original shape upon reduction of snarling forces; and the effect of rotational snarling forces is reduced.

DESCRIPTION OF THE PREFERRED EMBODIMENTS

Figure 1:
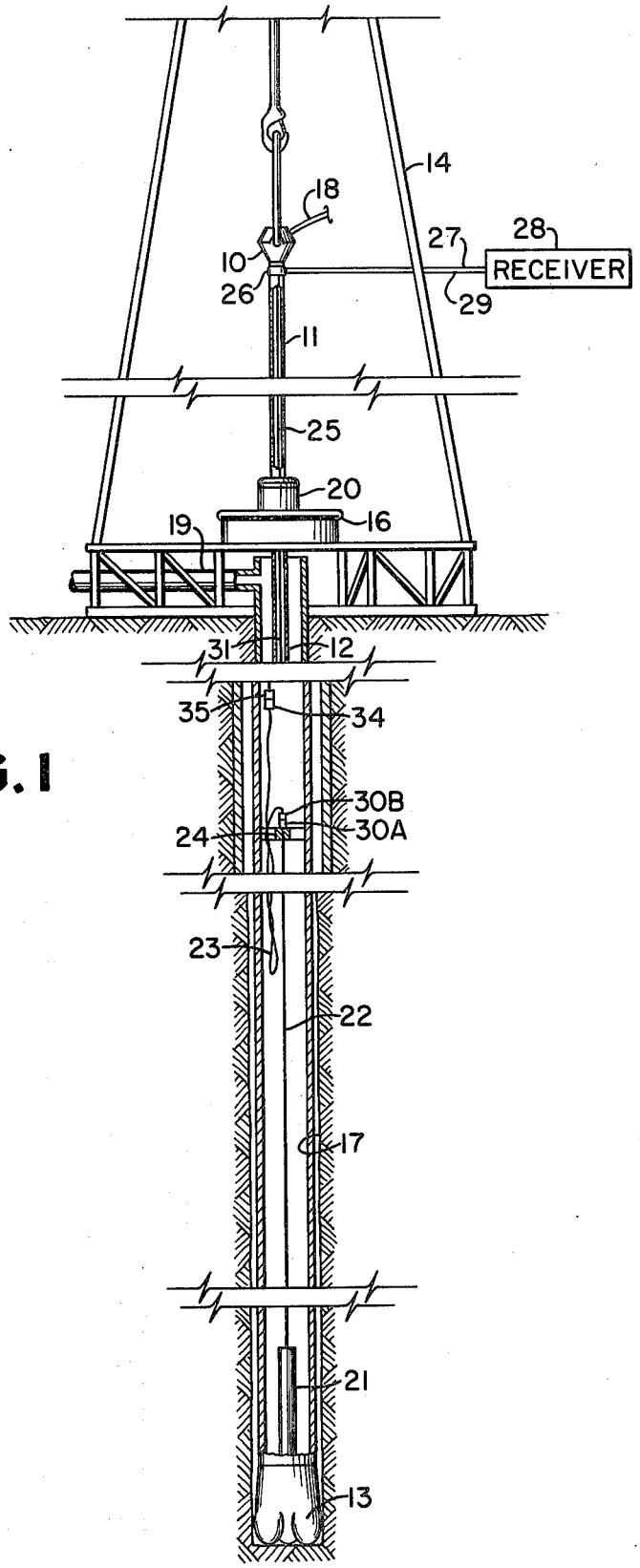
FIG. 1 is a schematic view of well drilling equipment provided with both stored soft-wire conductor and tensioned armored conductor for transmitting an electric signal between a subsurface and a surface location.

Conventional rotary drilling equipment, as schematically illustrated in FIG. 1 includes swivel 10, kelly 11, tubular drill string 12, and bit 13. These components, connected in the manner illustrated, are suspended from the drilling derrick 14 by means of rig hoisting equipment. The kelly 11 passes through rotary table 16 and connects to the upper end of the drill string 12. The term "drill string" as used herein refers to the column of tubular pipe between the bit 13 and the kelly 11; and the term "pipe string" refers to the complete pipe column including the kelly 11. The major portion of the drill string 12 normally is composed of drill pipe with a lower portion being composed of drill collars. The drill string 12 consists of individual pipe sections, either drill pipe or drill collars, connected together in end-to-end relation.

The borehole 17 is advanced by rotating the drill string 12 and bit 13 while at the same time drilling fluid is pumped through the drill string 12 and up the borehole annulus. The drilling fluid is delivered to swivel 10 through a hose (not shown) attached to hose connection 18 and is returned to the surface fluid system through pipe 19. A kelly bushing 20 couples the rotary table 16 to the kelly 11 and provides means for transmitting power from the rotary table 16 to the drill string 12 and bit 13. (The use of a power swivel eliminates the need for the kelly and rotary table. The present invention may also be used in systems which employ a power swivel in lieu of a kelly and rotary table. For purposes of illustration, however, it will be described in connection with the kelly and rotary table arrangement.)

As mentioned previously, it frequently is desirable to monitor a subsurface drilling condition during drilling operations. This requires measuring a physical condition at the subsurface location, transmitting this data as an electric signal to the surface, and reducing the signal to useful form. Typical situations where telemetry is applicable in drilling operations include drilling through abnormal pressure zones, drilling through zones where hole deviation is likely to be a problem, directional drilling, exploratory drilling and the like.

Although the present invention may be employed in almost any drilling operation wherein an electric conductor is used in tubular pipe to transmit electric energy between a subsurface and surface location, it finds particularly advantageous application in a wellbore telemetry system such as that illustrated in FIG. 1 which comprises an instrument 21, armored conductor portion 22, soft-wire conductor 23, support member 24 and receiver 28.

The instrument 21 capable of measuring a subsurface condition and generating an electric signal indicative or representative of that condition is mounted or adapted to be mounted in the drill string 12. A variety of devices capable of sensing a physical condition are available. These include transducers for measuring pressure, temperature, strain and the like; surveying instruments for measuring hole deviation; and logging instruments for measuring resistivity or other properties of subsurface formations. The instrument 21 may be powered by batteries or by energy transmitted through soft-wire conductor 23 and conductor 22. Alternatively, a subsurface generator driven by fluid flowing through the drill string 12 may be used to power instrument 21.

The present invention is concerned primarily with an apparatus and method for maintaining the electric conductor within the pipe string 12 during drilling operations. The energy transmitted may be a signal generated by the subsurface instrument 21 and transmitted from the surface to actuate or drive a subsurface instrument or motor. Alternatively, energy may be transmitted down soft-wire conductor 23 and conductor 22 to power the instrument 21, and simultaneously intelligence may be transmitted up these conductors.

In telemetry operations, it is preferred that the energy being transmitted be in the form of a pulsating signal. Information can be transmitted by varying the number, amplitude, width or spacing of a train of electric pulses, or it can be transmitted by modulating the frequency or amplitude of the pulsating signal. More than one transducer or other device may be employed in the instrument 21 if desired, in which case a multiplexer may be used for sending the various signals over a single conductor.

The present invention contemplates maintaining excess length of conductor within the pipe string 12 during drilling operations by using resilient, flexibly-insulated soft-wire conductor as the stored conductor. Suitable insulating materials include both natural and synthetic rubbers, as well as other synthetic insulating materials such as water-proofed resilient braided synthetic fibers of, e.g., polyester material or the like. The work "rubber" as used herein means any of the numerous synthetic eleastic materials of varying chemical composition, with properties similar to those of natural rubber, as well as natural rubber itself, which may be useful as an insulating coating in the present invention as defined later with greater particularity. It is contemplated that the armored conductor portion 22 will be maintained in tension, while the soft-wire conductor 23 is convoluted and inserted into the drill string in a random, free-hanging configuration. The terms "random" or "free-hanging" are used to denote that no specific configuration of stored conductor in the drill string is required, and that the use of special guides, pulleys or the like is unnecessary to maintain the integrity of the stored conductor during drilling operations.

As schematically illustrated in FIG. 1, the conductor 22 extends from instrument 21 up to support member 24 disposed in drill string 12, and is connected by means of connectors 30A and 30B with the excess length of free-hanging, soft-wire conductor 23, which is stored within the drill string without the use of a lower guide to maintain a storage loop and ultimately extends to the surface where connection is made with the lower tail portion 31 of the kelly conductor 25. Connection is made by means of connector 34 of conductor 23, which is adapted to mate with connector 35 located on the end of lower tail portion 31. The connectors 30A, 30B, 34 and 35 are preferably locking types, and may be those described in U.S. Pat. No. 3,807,502.

The lower tail portion 31 extends slightly more than the length of one pipe section below kelly 11. In this embodiment, the kelly conductor 25 extends through the kelly 11 and connects to a terminal located at the upper end of the kelly 11. It will be observed, however, that conductor 25 may be embedded in the kelly 11. The lower tail portion 31 may then be made a separate, appropriate length of conductor adapted to connect both to conductor 25 at the bottom of kelly 11 and to soft-wire conductor 23. In order to facilitate the addition of pipe sections to the drill string 12, however, it is preferred that conductor 25 extend through the interior of the kelly 11 as described and connect to the upper end of soft-wire conductor 23, at a distance equal to slightly more than one pipe section length below the lower end of kelly 11.

If telemetry operations are to be performed while the kelly 11 and drill string 12 are rotating, the upper end of conductor 25 will be connected to a device 26 capable of transmitting electric energy from a rotating member to a stationary member. Device 26 may be a rotary transformer having a rotor secured to the kelly 11 and a stator secured to the stationary portion of the swivel 10, or it may be a slip-ring and brush assembly. Device 26 and electric conductor 27 provide means for transmitting signals from the conductor string within the pipe string to receiver 28. The return path for the electric circuit may be provided by a variety of grounding circuits but preferably is through the pipe string or conductor armor. Conductor 29, part of the return path, interconnects stationary portion of device 26 and receiver 28. If telemetry operations are to be performed at times when the drill string 12 and kelly 11 are stationary, device 26 will not be needed and the conductors 27 and 29 may be connected directly to soft-wire conductor 23 and grounded through a suitable connector. In this situation, conductors 27 and 29 will be disconnected from soft-wire conductor 23 and ground when the kelly 11 and the drill string 12 are rotated. Other means for transmitting the signal to the receiver 28 include a wireless transmitter connected to conductors 23 or 25 and located on a rotating member, e.g. kelly 11.

Figure 2:
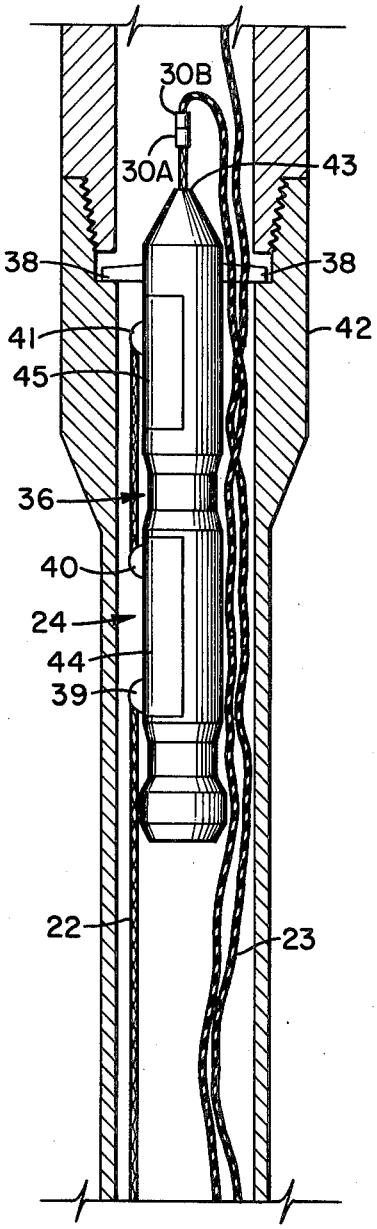
FIG. 2 is an enlarged longitudinal view of a portion of the drill string shown in FIG. 1.

As illustrated in FIG. 2, one embodiment of support member 24 comprises an elongated body 36, a cable gripping device (not shown), pivotally mounted support arms 38, and guide rollers 39, 40, and 41. Panels 44 and 45 are secured to body 36 by fasteners such as screws but are removable therefrom to permit conductor 22 to be properly placed in support member 24. To accomplish this, conductor 22 is reaved around roller 39, through cable gripping device located behind panel 44, around rollers 40 and 41 and up through a central opening which extends through the upper nose end 43 of support member 24. The cable gripping device permits conductor 22 to be pulled upward, but prevents downward movement, and thus maintains tension on conductor 22. A cable gripping device suitable for use in the present invention is described in U.S. Pat. No. 3,957,118.

When mounting support member 24 in the drill string 12, support arms 38 extend radially outwardly as illustrated and rest on the box end 42 of a drill pipe section. The arms 38, however, are pivotable downwardly into suitable slots formed in the body 36 to permit the assembly to be retrieved from the drill string 12 if desired.

Figure 4:
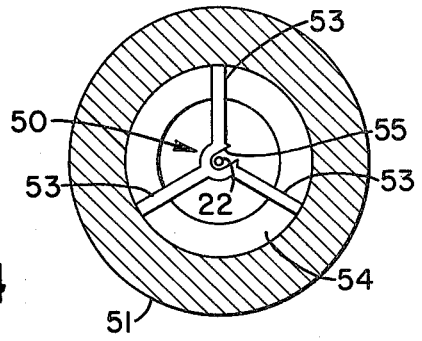
FIG. 4 is a transverse sectional view of the assembly shown in FIG. 3 with the cutting plane taken along line 4—4 thereof.
Figure 3:
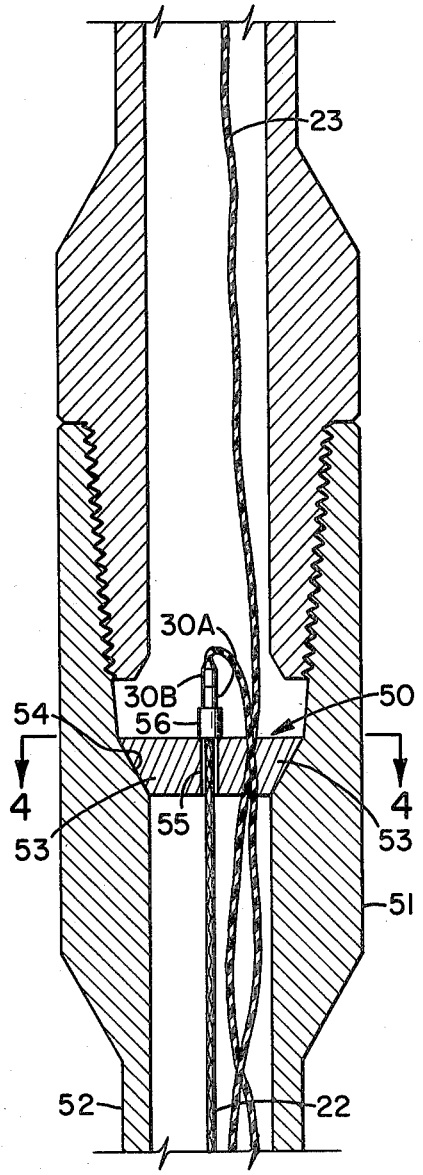
FIG. 3 is an enlarged sectional view of a support member for supporting a conductor section within the drill string in accordance with the present invention.

Alternatively, a mechanically simpler support member may be used, such as the spider assembly shown in FIGS. 3 and 4. As shown, the spider 50 for supporting the upper end of the conductor 22 is sized to fit into a box end 51 of a pipe section 52. Radial arms 53 rest on internal shoulder 54 of the box end 51 and an opening 55 through the axial center of the spider assembly 50 receives the upper end of conductor 22. The spider assembly 50 should be designed to minimize the flow restriction through box 51 particularly if internal upset drill pipe is used. A cable clamp 56 anchors the armor of conductor 22. The conductor 22 passes through the center opening of clamp 56, which is supported on the upper surface of spider 50 when installed.

A more detailed discussion of a suitable spider assembly is provided in U.S. Pat. No. 3,807,502 (issued to Heilhecker et al on Apr. 30, 1974).

The receiver 28 is an instrument capable of receiving the signal generated by instrument 21 and reducing it to useful form.

The apparatus may be installed within a drill string by the following procedure. The conductor 22 with instrument 21 or instrument connector suspended thereon is positioned at the upper end of the borehole 17. One end of the soft-wire conductor 23 desired to be stored is releasably attached to any convenient surface member. The other end is attached to kelly conductor 25. A point on the soft-wire conductor equaling one-half the length of conductor to be stored is releasably attached by means of tape or other releasable attaching means to conductor string 22 just above instrument 21 or instrument connector. The conductor 22 with the instrument 21 suspended thereon and soft-wire conductor 23 attached thereto is then lowered within the drill string 12. Soft-wire conductor 23 is thus located within the drill string 12 as the instrument is lowered, breaking free from conductor 22 as the instrument 21 is lowered below the limit of travel of the soft-wire conductor to provide a free-hanging storage loop. Alternatively, a fluid-soluble weight and link can be utilized to pull the soft-wire conductor down to the lowest part of its loop. For example, a paper sack filled with barites and linked to the soft-wire conductor 23 with a toroidal candy "link" (e.g., a "Lifesaver" mint) has been used.

Instrument 21 is then further lowered until located and anchored at the proper subsurface location. The conductor 22 is then disposed within support member 24, which is securely mounted in the drill string 12, as previously described. A force is then pulled on conductor 22 at the surface. Tensioning of the conductor 22 results, which is maintained by the cable gripping device located in support member 24 of FIG. 2. The force required will vary, depending on the weight of the conductor 22 and support member 24.

Alternatively, if spider assembly 50 is used as the support member, the following procedure is used. After anchoring instrument 21 at the subsurface location, the upper end of conductor 22 is provided with cable clamp 56. The spider assembly 50 is inserted on the cable 22 immediately below the cable clamp 56. This assembly is then seated in a box end 51 of drill pipe, e.g. pipe section 52, so as to provide tension on conductor 22.

A connector 30A is then provided to the conductor string 22 just above support member 24. The connector 30A of conductor 22 is mated with companion connector 30B of soft-wire conductor 23. Connector 30B is located on the end of rubber-coated conductor 23 that was originally attached to a surface member when introducing excess conductor into the drill string 12. With conductor 22 properly tensioned, soft-wire conductor 23 stored within drill string 12, and the upper terminal end of soft-wire conductor 23 connected to the lower tail portion 31 of kelly conductor 25 by means of connectors 34 and 35, electrical continuity is established within the drill string 12. Connection of kelly 11 to the drill string 12 places the equipment in condition for drilling and for performing telemetry operations if desired. The telemetry operations may be performed as drilling is in progress.

When it becomes necessary to lengthen the drill string 12, telemetry and drilling operations are momentarily interrupted and a pipe section is introduced into the drill string 12 by the following procedure. The drill string 12 is suspended in the rotary table 16; kelly 11 is disconnected from the drill string 12 and elevated until connectors 34 and 35 are withdrawn. This shortens the length of soft-wire conductor 23 which is stored in drill string 12. Connectors 34 and 35 are separated and with connector 34 supported on the upper end of drill string 12, the tail portion 31 of kelly conductor 25 is threaded through the pipe section to be added. The kelly 11 is then connected to the upper end of the additional pipe section. This assembly is elevated above the pipe string 12. After reconnecting the connectors 34 and 35, the additional pipe section is screwed into the drilling string 12, placing the equipment in condition to resume drilling and telemetry operations.

The length of soft-wire conductor 23 thus enables storage of excess lengths of conductor within the pipe string 12. The excess conductor is used up in increments as each additional pipe section is added. When the excess lengths of conductor 23 are used up, the conductor system normally will be withdrawn from the drill string.

In order for the telemetry system to operate for long intervals, it is desirable to store as much soft-wire conductor as possible in the pipe string, which results in long lengths of overlapped conductor portions being disposed in the pipe string in a free-hanging, random fashion. The present invention utilizes a resilient, flexible soft-wire conductor as the portion stored in the drill string. The soft-wire conductor utilized consists of a small-diameter, very flexible conducting core comprised of a large number of small strands of wire, covered by a rubber or other suitably flexible coating of substantial thickness.

The use of a rubber-like compound as the insulating sheath is important in the development of a suitable soft-wire conductor which will resist permanent entanglement or kinking during drilling operations. A suitable rubber-like material will demonstrate a characteristic stress-strain response in tension. A stress-strain curve can be generated by applying tensile stresses to a material and plotting stress values versus measured percent elongation.

For non-suitable insulating materials, the elastic portion of the curve will change abruptly from that of a relatively high Young's modulus (steep slope) at low strains to that of a material with a relatively lower Young's modulus (gradual slope) at strains of 25–100%. At the point of abrupt change, a small increase in stress results in catastrophic strain (yielding); for cables, this would mean that no recovery from snarling could be achieved.

Suitable insulating materials, by contrast, give a relatively smooth curve; i.e. there is no abrupt change in the elastic modulus. An increase in strain is met by a nearly proportional increase in stress at any segment of the curve. Thus, there is no point of catastrophic failure, and, therefore, a conductor utilizing such materials is capable of recovering its original shape after being snarled.

A suitable elastomeric material for use as an insulating sheath in the soft-wire conductor preferably has certain mechanical properties for satisfactory results. Two parameters commonly used to indicate the mechanical properties of elastomers are elongation and elongation modulus (sometimes referred to simply as "modulus"). Elongation gives an increase in length expressed as a percent of initial specimen length, and generally is reported as the increase at break of a specimen. This property provides an indication of the resiliency of an elastomer, i.e. the ability to "snap back" after being stretched (or snarled). The elongation modulus simply refers to stress at a predetermined elongation. The higher the modulus, the more apt a material is to recover from a peak overload or localized force.

The insulating sheath of a suitable soft-wire conductor preferably utilizes a material that has an elongation of at least about 150% and preferably greater than about 200%. The material's elongation modulus should preferably be greater than about 500 psi at 100% elongation.

Further, the elastomer used as an insulating sheath, and having the preferred mechanical properties, should demonstrate the desired stress-strain behavior, i.e. a relatively smooth curve when measuring stress versus percent elongation.

A more extended discussion of elastic behavior may be found in U.S. Pat. No. 3,865,776 (issued to W. P. Gergen on Feb. 11, 1975) and also in the Parker O-Ring Handbook, Parker Seal Co., p. A3–1 to A3–7 (1974).

Two major snarling forces attendant to rotary drilling must be considered in the design of a suitable soft-wire conductor: (1) angular acceleration or deceleration forces when starting or stopping rotary drilling; and (2) drag forces due to the flow of drilling mud.

Where the specific gravity of the electrical conductor is substantially greater than the specific gravity of the drilling mud, the angular acceleration or deceleration forces resulting from swirling drilling mud tend to snarl the conductor. However, it has been found that by designing the electrical conductor such that its specific gravity is approximately the same as the drilling mud, the twisting effect of the angular forces on the conductor can be greatly reduced because the conductor will tend to accelerate or decelerate at the same rate as the drilling mud. Since drilling mud generally has a specific gravity of between about 1.0 and about 2.0, the soft-wire conductor preferably should be designed with a specific gravity within this range. Natural rubber has a specific gravity of approximately 1.0 and therefore is well suited as an insulator for the soft-wire conductor. However, synthetic rubbers such as polyisoprene or ethylene-propylene rubbers (EPR and EPDM) possess similar properties and may be utilized just as easily. Alternatively, resilient water-proofed braided fiber covers, which often have a specific gravity of less than 1.0, may be used.

The average specific gravity of the soft-wire conductor will be greater than the specific gravity of insulating sheath alone, due to the wire conducting core. By adjusting the ratio of the total outside diameter to the core diameter, a specific gravity within the range of drilling mud densities can be obtained.

Drag forces on a stored conductor increase directly in proportion to increases in the outside diameter of the soft-wire conductor. The strength of the soft-wire conductor, i.e. the ability to resist breaking under drag forces, is provided by the wire conducting core and is proportional to the square of the core diameter. Thus, as the diameter of the conductor is increased, the strength of the soft-wire conductor increases. By correlating the drag forces on a soft-wire conductor having a given outside diameter with the strength of the soft-wire conductor, the maximum length of conductor capable of being stored within a drill string without breaking can be calculated. Since the strength of the soft-wire conductor is proportional to the square of the core diameter, while the drag forces are proportional to the first power of the outside diameter, the maximum length capable of being stored increases with increases in the outside diameter of the soft-wire conductor as long as the same diametric ratio, i.e. ratio of outside diameter to core diameter, is maintained to give the proper specific gravity. Thus, a range of diametric ratios exists which defines a soft-wire conductor having both the requisite strength and specific gravity suitable for practicing the present invention.

Specifying a diametric ratio does not completely define the mechanical behavior of a suitable soft-wire conductor, however, since the tendency of a soft-wire conductor to straighten once bent, i.e. resiliency, varies proportional to the cube of the outside diameter and to the first power of the elastic modulus. Thus, the design of a suitable soft-wire conductor possessing sufficient resiliency requires the specification of a suitable outside diameter. Once an appropriate insulating material and a diametric ratio are found giving the proper specific gravity, the resiliency and strength of the soft-wire conductor may be increased by increasing the outside diameter of the conductor. The maximum outside diameter, however, is limited by practical considerations, i.e. the outside diameter must not be so large as to prevent insertion into the drill string or to substantially reduce fluid flow.

It has been found that the required specific gravity, strength and resiliency characteristics are obtained in a conductor having an EPDM rubber outer sheath and a multi-strand inner conducting core of copper with a diametric ratio of about 3.2 to about 3.6 and an outside diameter of about 0.144 inches. Since the mud velocity in a drill string may be typically about 36 ft. per second, the maximum length of this soft-wire conductor able to withstand the resulting drag forces is about 1,000 ft. A suitable soft-wire conductor is Belden Corporation "Test Prod Wire" Number 8899. Calculations have shown that a suitable rubber-coated conductor may have an outside diameter of between about 0.12 inches and about 0.20 inches, and a specific gravity of between about 1.0 and about 2.0. Outside these ranges the rubber-coated conductor would likely either have insufficient strength to permit storage of practical amounts in the drill string, or have excessive bulk, giving handling and performance difficulties.

Where substantial quantities of hydrocarbons which might chemically attack natural rubber exist in the drilling fluid, as with an oil based drilling mud or with influx of oil from a reservoir, oil-resistant synthetic rubbers may be used to form the outer sheath. Examples of oil resistant rubbers include organic polysulfides, butadiene-acrylonitrile copolymers and neoprene. Since the properties of a rubber compound can be varied greatly by the choice of fillers, softeners, accelerators, condition of cure, and many other factors, the desired physical properties for a suitable soft-wire conductor useful in wellbore telemetry operations can be obtained by careful formulation. Design is facilitated since the specific gravity of any of these synthetic materials prepared without fillers falls near that of natural rubber, i.e. about 1.0. Further, a braided fiber insulating sheath or cover impregnated with one of the above compounds can give additional variation in specific gravity and tensile strength.

Although the present invention has been described with reference to conventional rotary drilling operations, it can also be used with other types of drilling equipment, including turbodrills and positive displacement hydraulic motors. These devices normally include a motor or turbine mounted on the lower end of the drill string and adapted to connect to and drive a bit. The motor or turbine powered by the drilling fluid drives the drill bit while the drill string remains stationary. When this type of subsurface drilling device is used in directional drilling operations, the present invention provides a highly useful means of transmitting directional data to the surface.

What is claimed is:

1. In a system for maintaining electrical continuity between a subsurface location in a drill string and a location substantially at the surface, wherein an insulated electrical conductor its disposed in said drill string, said conductor having a looped portion to provide storage of excess conductor in said drill string, the improvement wherein said looped portion is untensioned and free-hanging within said drill string and is composed of a flexible, insulated conductor, the specific gravity of said conductor is substantially equivalent to the specific gravity of the drilling fluid flowing in said drill string, said conductor having a conducting multi-strand inner core and a resilient, insulating outer sheath, the diametric ratio of said outer sheath to said inner core being between about 3.2 and about 3.6, and an outside diameter of between about 0.12 inches and 0.20 inches.

2. The system of claim 1 wherein said conductor has a specific gravity of between about 1.0 and about 2.0.

3. A system as defined in claim 1 wherein said outer sheath is formed from natural rubber.

4. A system as defined in claim 1 wherein said outer sheath is formed from an oil-resistant, synthetic rubber.

5. The system of claim 1 wherein said outer sheath is formed from a water-proofed resilient braided synthetic fiber.

6. In a system for maintaining electrical continuity in a drill string which includes an armored cable which extends from a first subsurface location to a second subsurface location, said first location being substantially below said second location, means at said second location for maintaining said armored cable in tension, a flexible, resilient cable connected to said armored cable proximate to said second location, said flexible, resilient cable extending therefrom to a surface location, the length of said flexible, resilient cable initially being substantially longer than the distance between said second location and said surface location, the improvement wherein:

said flexible, resilient cable is arranged in said drill string in a free-hanging untensioned, random fashion, and includes an inner, flexible conducting multi-strand core, and an outer, resilient elastomeric sheath, said flexible, resilient cable having a specific gravity substantially equivalent to the specific gravity of the drilling fluid flowing on said drilling string, the diameter of said core and thickness of said sheath being such that said flexible, resilient cable has sufficient resiliency to resist permanent deformation when subjected to torsional forces resulting from accelerating or decelerating the rotation of said drill string and has a strength in lengths of about 1000 feet sufficient to withstand the frictional drag of fluids moving in said drill string at velocities of up to about 36 feet per second.

7. The system of claim 5 wherein flexible, resilient cable has a specific gravity of between about 1.0 and about 2.0.

8. A method of mounting and maintaining an electrical cable in a rotary pipe string to provide an electric circuit between a subsurface and surface location and to store cable in said pipe string which comprises:

lowering an armored cable in said pipe string;

anchoring the lower end of said armored cable at said subsurface location in said pipe string;

maintaining the armored cable between said subsurface location and an upper location in said pipe string in tension;

connecting one end of a resilient, flexibly-insulated cable to the upper end of said armored cable, and connecting the other end to said surface location;

introducing an intermediate portion of said flexibly-insulated cable into said pipe string to form a free-hanging untensioned loop to store portions of cable therein, said flexibly-insulated cable having sufficient resiliency to prevent permanent cable entanglement and a specific gravity substantially equivalent to the specific gravity of the drilling fluid flowing in said drill string; and extending said flexibly-insulated cable through additional pipe sections added to said pipe string, the stored portions of cable having a sufficient length to enable the extension of said flexibly-insulated cable through said additional pipe sections.

9. A method of drilling a well while maintaining an electric circuit between a subsurface location and surface location which comprises:

(a) lowering a pipe string in said well, said pipe string comprising a plurality of pipe sections;

(b) lowering a reinforced cable until its lower end detachably makes electric and mechanical connection with a subsurface terminal, said reinforced cable extending therefrom substantially to the surface;

(c) placing and maintaining in tension said reinforced cable by means of a cable gripping device;

(d) storing in a free-hanging untensioned fashion an excess length of a flexible elastomer-coated cable at least equal to the length of a pipe section; said elastomer-coated cable having a mulistrand conducting inner core and elastomeric outer sheath, the diametric ratio of said outer sheath to said inner core being between about 3.2 and about 3.6, said flexible elastomer-coated cable having a specific gravity substantially equivalent to the specific gravity of the drilling fluid flowing in said drilling string;

(e) connecting one end of said elastomer-coated cable to the upper end of said reinforced cable and connecting the other end of said elastomer-coated cable to a surface terminal, thereby establishing electric circuit between said subsurface and surface terminals;

(f) advancing said well sufficiently to require the insertion of an additional pipe section into said pipe string; disconnecting said pipe string and separating said elastomer-coated cable at the surface; threading said elastomer-coated cable through an additional pipe section; reconnecting said elastomer-coated cable to reestablish electric continuity between said terminals through said pipe string including said additional pipe section; and inserting said additional pipe section into said pipe string.

10. In a system for maintaining electrical continuity between a subsurface location in a drill string and a location substantially at the surface, wherein an insulated electrical conductor is disposed in said drill string, said conductor having a looped portion to provide storage of excess conductor in said drill string, the improvement wherein said looped portion is free-hanging within said drill string and is composed of a resilient flexibly-insulated conductor having a conducting multistrand inner core and a resilient, insulating outer sheath, the diametric ratio of said outer sheath to said inner core being such that said looped portion has a resultant specific gravity approximately the same as drilling fluid within said drill string, said inner core having sufficient strength to withstand the drag forces of drilling fluids past said looped portion.

11. In a system for maintaining electrical continuity between a subsurface location in a drill string and a location substantially at the surface, wherein an insulated electrical conductor is disposed in said drill string, said conductor having a looped portion to provide storage of excess conductor in said drill string, the improvement wherein said looped portion is untensioned and free-hanging within said drill string and is composed of a resilient flexibly-insulated conductor having a conducting inner core and a resilient, insulating outer sheath.

12. A system as defined in claim 11 wherein the specific gravity of said conductor is substantially equivalent to the specific gravity of the drilling fluid flowing in said drill string.

13. In a system for maintaining electrical continuity between a subsurface location in a drill string and a location substantially at the surface while drilling, wherein an insulated electrical conductor is disposed in said drill string, said conductor having a looped portion to provide storage of excess conductor in said drill string, the improvement wherein said looped portion is random and free-hanging within said drill string without tensioning means and is composed of a resilient flexibly-insulated conductor having a conducting inner core and a resilient, insulating outer sheath.

14. A system as defined in claim 13 wherein the specific gravity of said conductor is substantially equivalent to the specific gravity of the drilling fluid flowing in said drill string.

* * * * *